US005144706A

United States Patent [19]

Walker

[11] Patent Number: 5,144,706

[45] Date of Patent: Sep. 8, 1992

[54] BED FOUNDATION

[76] Inventor: Robert A. Walker, 11010 89th Ave., North, Maple Grove, Minn. 55369

[21] Appl. No.: 620,553

[22] Filed: Dec. 3, 1990

[51] Int. Cl.[5] ..... A47C 19/00

[52] U.S. Cl. ..... 5/400; 5/201; 5/285; 24/589

[58] Field of Search ..... 5/400, 201, 285, 228.1, 5/200.1; 403/407.1; 24/589, 660

[56] References Cited

U.S. PATENT DOCUMENTS

| | | | |
|---|---|---|---|
| 64,175 | 8/1867 | Webster | 5/201 |
| 1,853,111 | 4/1932 | Bienefeld | 24/589 |
| 2,518,983 | 8/1950 | Ehrlich . | |
| 2,642,928 | 6/1953 | Bateman et al. . | |
| 4,128,907 | 12/1978 | Gelbart | 5/200.1 |
| 4,391,008 | 7/1983 | Tamaoka | 5/285 |
| 4,402,097 | 9/1983 | Scott . | |
| 4,675,929 | 6/1987 | Santo | 5/400 |
| 4,679,261 | 7/1987 | Stanley | 5/282.1 |
| 4,696,071 | 9/1987 | Santo | 5/400 |
| 4,734,946 | 4/1988 | Saputo | 5/400 |

FOREIGN PATENT DOCUMENTS

| | | | |
|---|---|---|---|
| 0009905 | 4/1980 | European Pat. Off. | 5/200.1 |
| 0180099 | 5/1986 | European Pat. Off. | 5/400 |
| 74348 | 5/1932 | Sweden | 5/201 |

*Primary Examiner*—Renee S. Luebke
*Assistant Examiner*—F. Saether
*Attorney, Agent, or Firm*—Burd, Bartz & Gutenkauf

[57] ABSTRACT

A plurality of foundation sections are interlocked with releasable latch devices to form a mattress support. The foundation sections include two center sections that are shorter than end sections to enable the center sections to be packed within the end sections. Side members can be releasably connected to the center sections to complete the foundation. The foundation sections can be stacked and placed within a container having a size within the shipping limits of the United Parcel Service.

21 Claims, 6 Drawing Sheets

BED FOUNDATION

FIELD OF THE INVENTION

The invention relates to foundations for supporting a mattress, particularly, bed foundations having a plurality of sections that are releasably attached.

BACKGROUND OF THE INVENTION

Commonly, bed foundations are sold fully assembled. They cannot be disassembled for shipping and occupy large amounts of shipping and storage space resulting in increased costs to the consumer. Often, the bed foundations are heavy, cumbersome objects that are difficult to move into confined areas.

The use of foundation sections that are releasably connected together to form a bed foundation is known in the art. F. M. Scott, in U.S. Pat. No. 4,402,097, discloses a mattress support having a plurality of interlocking sections. Pins and holes for the pins and releasable latches are used to retain the sections together. Stacking of foundation parts in a container is also known in the art. R. A. Saputo, in U.S. Pat. No. 4,734,946, discloses a knock-down foundation having a plurality of releasably attached sections that form a rectangular base. The foundation can be collapsed to a stack of components for shipment in a single carton. P. J. Santo, in U.S. Pat. No. 4,675,929, discloses a four-section pedestal for a mattress. The separate sections can fit into a box container.

SUMMARY OF THE INVENTION

The invention is directed to an improved bed foundation having a plurality of sections that are easily and quickly joined together to make a rectangular support for a mattress. The components of the foundation can be stacked together and placed into a single box of a size that can be shipped via United Parcel Service. The sections are interlocked together at the user's site to form a solid bed foundation without the use of tools. A plurality of latches connecting the foundation sections are releasable to facilitate disassembly of the foundation.

A preferred embodiment of the bed foundation has a first end member and a second end member joined to a pair of center members to form a support for a mattress. A cover fits over and is removably mounted on the support. The cover can be cleaned or replaced when necessary. A plurality of releasable latches connect the end members to the center members. The latches are mounted on adjacent surfaces of the end members and center members. Each latch has a base secured to one adjacent surface and a retainer secured to an opposite adjacent surface. A latching member is pivoted to the base and engageable with the retainer to lock the base and retainer together. The base has at least one outwardly directed tab that is accommodated by a groove in the retainer. This ensures proper alignment of the end members relative to the center members. A pair of live hinges connect the base to the latching member. The hinges are movable between an expanded position and a contracted position so as to allow the latching member to engage the retainer and lock the base and retainer together. A cover material surrounds the adjacent surfaces of each end member and center member. Locking the latch compresses the cover material to prevent gapping between the adjacent surfaces.

A transverse support extends between the center members. A first longitudinal support extends between the first end member and the transverse support. A second longitudinal support extends between the second end member and the transverse support. The first and second longitudinal supports are in axial alignment. A plurality of U-shaped brackets secured to the end members, center members and transverse support accommodate the ends of each support with a friction fit. One bracket is secured to one side of the transverse support. A second bracket is attached to the opposite side of the transverse support adjacent the first bracket. These brackets hold adjacent ends of the first and second longitudinal supports in axial alignment.

The end members, center members and the transverse and longitudinal supports of the foundation are separable from each other. The separate foundation components can then be packed within a container having a size substantially the same as one of the end members. The size of the container is at most 130 inches transverse peripheral and length. The center members each have a size that is smaller than the size of each end member so that the center members can be stacked within one of the end members. Each support has a length that is shorter than the diagonal length of each end member whereby the supports can also be stacked within one of the end members. This facilitates shipping and reduces cost to the consumer.

A modification of the foundation has a first end section and a second end section releasably connected to a pair of side members. The side members are releasably connected to a pair of center sections to form a rectangular support for a mattress. A plurality of latches are used to releasably lock adjacent edges of the end sections, side members and center sections together. Each end section, side member and center section has a cover material surrounding each adjacent edge. The latches compress the cover material when locking the adjacent edges together. This eliminates gapping between the adjacent edges. A transverse support and first and second longitudinal supports mounted on the end sections and side members longitudinally and laterally support the end and center sections and the side members. The transverse support extends between the side members. The first and second longitudinal supports extend between the transverse support and the first and second end sections. The first and second longitudinal supports are in axial alignment. The end sections, side members, center sections and supports are separable from each other and packable within a container having a size substantially the same as one of the end sections. The size of the container is at most 130 inches transverse peripheral and length. The center sections and side members each have a size that is smaller than the size of each end section whereby the center sections and side members can be placed within one of the end sections.

DESCRIPTION OF PREFERRED EMBODIMENTS

Figure 1:
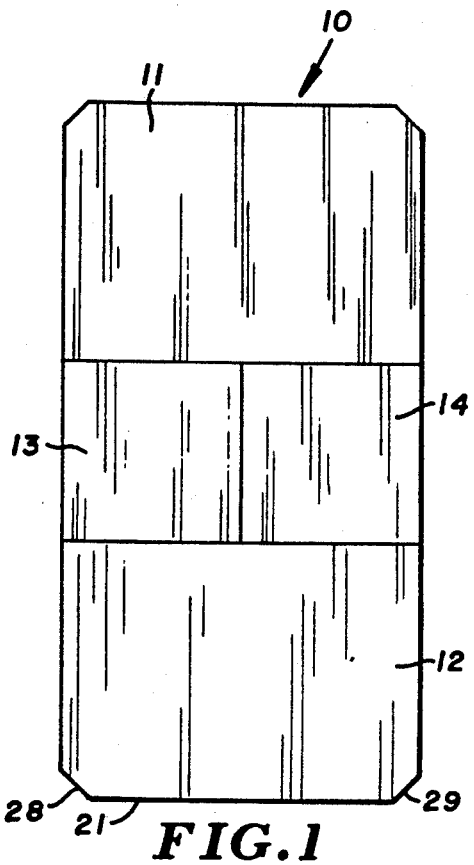
FIG. 1 is a top plan view of the foundation of the invention.
Figure 2:
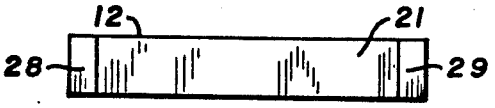
FIG. 2 is an end view thereof.
Figure 3:
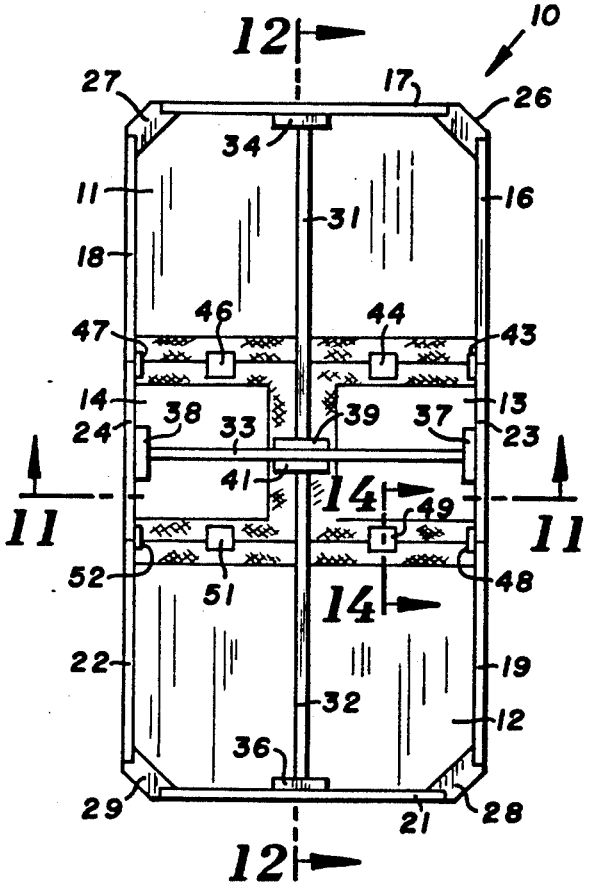
FIG. 3 is a bottom plan view thereof.
Figure 4:
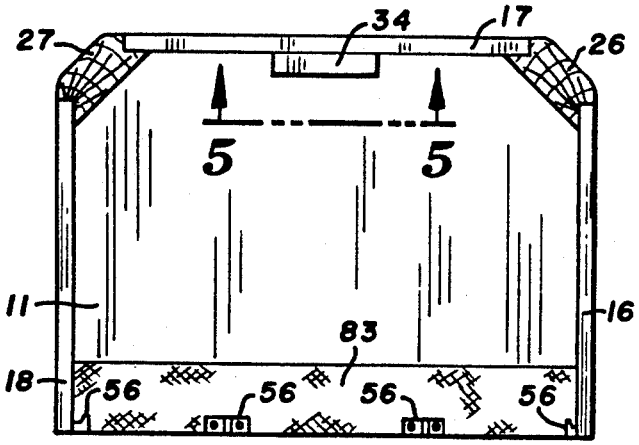
FIG. 4 is an enlarged bottom view of an end section of the foundation of FIG. 1.

Referring to FIGS. 1, 2 and 3, there is shown a bed foundation of the invention indicated generally at 10 having a plurality of sections that are interlocked together to form a stationary structure for supporting one or more mattresses, such as an air mattress. The sections are of a size so that they can be stacked together for storage and shipping. The sections of bed foundation 10 can fit into a box having a size within the shipping limits of UPS (United Parcel Service), i.e., 130 inches transverse peripheral and length. This allows bed foundation 10 to be manufactured at a single location and shipped via UPS directly to the retailer or user. Shipping bed foundation 10 by UPS lowers the cost of transporting the foundation. Bed foundation 10 can be used in confined areas. The sections of bed foundation 10 can be moved piece by piece into a room and assembled in the room. Further, the sections of bed foundation 10 can be moved by one person. Also, no tools are required to assemble bed foundation 10.

Figure 8:
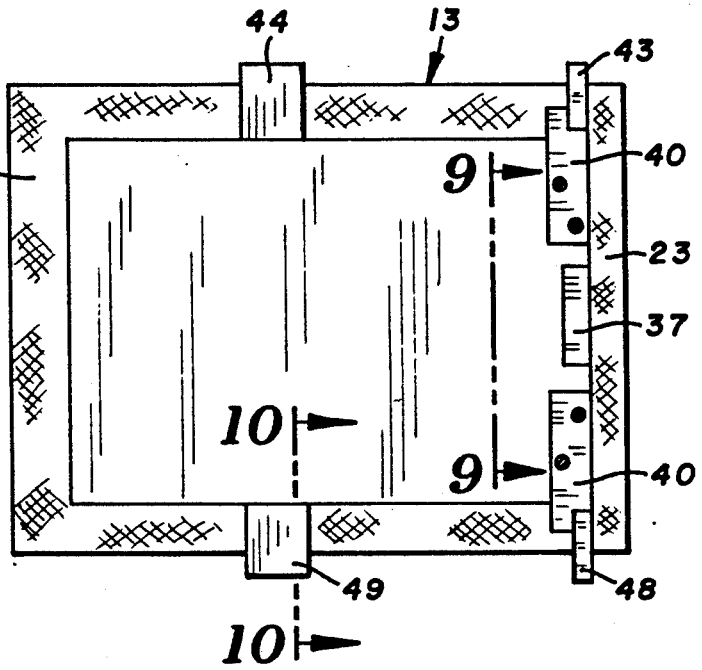
FIG. 8 is an enlarged bottom view of a center section of the foundation of FIG. 1.

Bed foundation 10 has a pair of generally rectangular end sections 11 and 12 joined to a pair of generally square center sections 13 and 14. Each center section 13, 14 has a shorter width and length than the width and length of end sections 11,12. This allows the center sections to be packed within one of the end sections for shipping. Foundation 10 forms a stationary structure for supporting a twin bed sized mattress, such as an air mattress. End section 11 of foundation 10 has side walls 16 and 18 connected to an end wall 17 with corner supports 26 and 27. End section 12 has side walls 19 and 22 connected to an end wall 21 with corner supports 28 and 29. Center sections 13 and 14 have side walls 23 and 24 secured to the outer side edges of the center sections. As shown in FIG. 8, triangular braces 40 attached to side wall 23 and center section 13 support side wall 23. Similar triangular braces attached to side wall 24 and center section 14 support side wall 24. Returning to FIG. 3, side walls 16 and 19 of end sections 11 and 12 are in longitudinal alignment with side wall 23 of center section 13. Side walls 18 and 22 of end sections 11 and 12 are in longitudinal alignment with side wall 24 of center section 14. Side walls 16, 18, 19, 22, 23 and 24 and end walls 17 and 21 are wood beams connected to the peripheral edges of end sections 11 and 12 and center sections 13 and 14.

Figure 5:
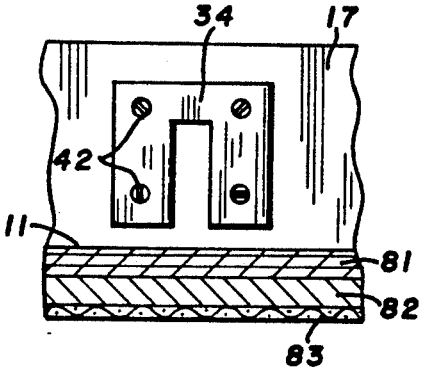
FIG. 5 is an enlarged sectional view taken along the line 5—5 of FIG. 4.

Each of the end and center sections 11 to 14 has a top panel 81 made of plywood, hardboard, chipboard and like sheet members. As shown in FIG. 5, a middle layer 82 of cardboard is attached to the top of each panel 81. A cover 83 made of cloth or like textile material extends over the top of cardboard layer 82 and the outer peripheral edges of each section 11 to 14. The ends of cover 83 are attached to the bottom and inner surfaces of each section 11 to 14.

A plurality of releasable latches 43, 44, 46, 47, 48, 49, 51 and 52 are used to hold end sections 11 and 12 and center sections 13 and 14 together. Latches 43, 44, 46 to 49, 51 and 52 prevent relative movement between sections 11 to 14.

As shown in FIG. 3, latches 43 and 44 connect adjacent ends of end section 11 and center section 13. Latch 43 is mounted on adjacent ends of side walls 16 and 23. Latch 44 is mounted on adjacent bottom surfaces of panels 81 of end section 11 and center section 13. Adjacent ends of end section 11 and center section 14 are connected with latches 46 and 47. Latch 46 is secured to adjacent bottom surfaces of panels 81 of end section 11 and center section 14. Latch 47 is secured to adjacent ends of side walls 18 and 24. Adjacent ends of end section 12 and center sections 13 and 14 are connected with latches 48, 49, 51 and 52 in an identical manner. Latches 48 and 52 are mounted on adjacent ends of side walls 19 and 23 and side walls 22 and 24, respectively. Latches 49 and 51 are secured to adjacent bottom surfaces of panels 81 of end section 12 and center sections 13 and 14. Latches 43, 44, 46 to 49, 51 and 52 can be easily locked and released to facilitate assembly and knock down of bed foundation 10.

Figure 10:
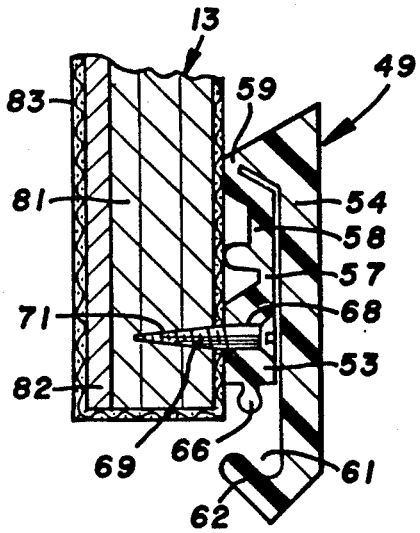
FIG. 10 an enlarged sectional view taken along the line 10—10 of FIG. 8.
Figure 13:
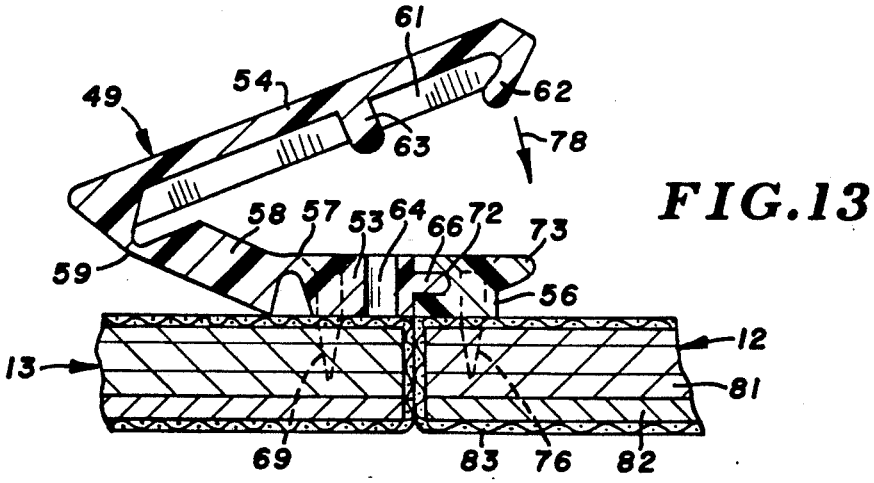
FIG. 13 is an enlarged sectional view of the foundation latch in the open position.
Figure 14:
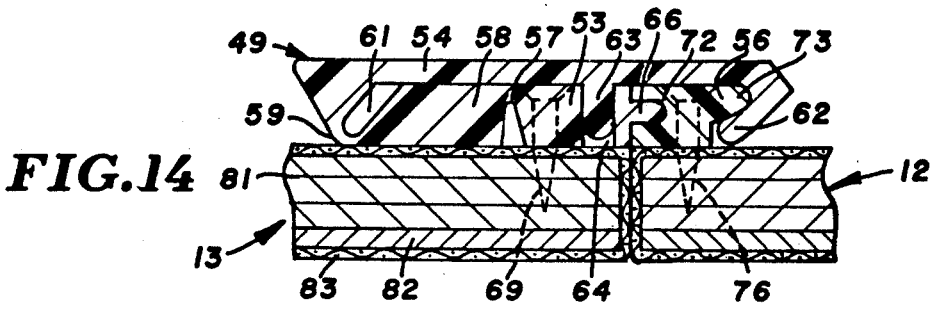
FIG. 14 is an enlarged sectional view taken along the line 14 —14 of FIG. 1 showing the latch in the closed position.

Latches 43, 44, 46, 47, 48, 49, 51 and 52 are generally flat releasable locking devices. The following description is limited to latch 49 that connects adjacent ends of end section 12 and center section 13 together. Latches 43, 44, 46 to 48, 51 and 52 are identical in structure and function to latch 49. As shown in FIGS. 10, 13 and 14, latch 49 has a generally rectangular base 53 joined to movable member 54 that hooks onto a retainer 56 to close latch 49. Movable member 54 is released from retainer 56 to open latch 49. Base 53 is joined to one end of a middle portion 58 with a hinge 57. The opposite end of middle portion 58 is connected to an end of movable member 54 with a second hinge 59. Hinges 57 and 59 are live hinges that expand and contract to allow movable member 54 to engage retainer 56 and lock base 53 and the retainer together. Movable member 54 is a generally rectangular member having a flat top. Movable member 54 has a lower recess 61 that accommodates base 53, middle portion 58 and retainer 56. A lip 62 extends inwardly and downwardly from the end of movable member 54 opposite hinge 59. Lip 62 is engageable with retainer 56 to lock latch 49. A post 63 projecting downwardly from the mid-section of movable member 54 is in longitudinal alignment with a hole 64 provided in base 53. Post 63 extends into hole 64 with a friction fit to secure movable member 54 to base 53. Base 53 has bores 68 accommodating screws 69 that are threaded into bores 71 in center section 13 to attach base 53 to the bottom surface of section 13. Base 53 is attached adjacent the end of section 13 whereby lip 62 of movable member 54 is located outwardly from the end of section 13 when the movable member is in the closed position, as shown in FIG. 10.

Figure 6:
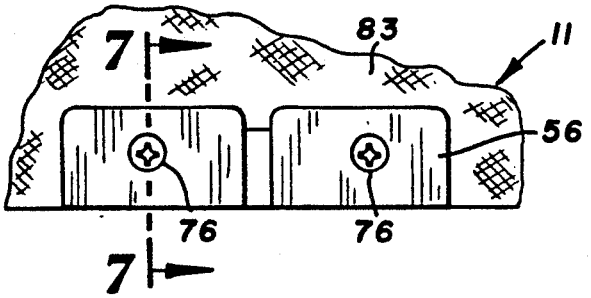
FIG. 6 is an enlarged view of a retainer of the foundation latch attached to the end section.
Figure 7:
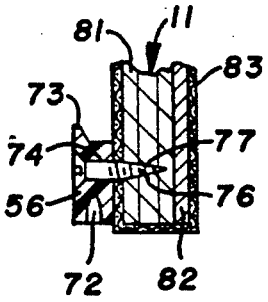
FIG. 7 is a sectional view taken along the line 7—7 of FIG. 6.

Referring to FIGS. 6 and 7, retainer 56 is mounted on end section 11 with screws 76. Screws 76 extend through bores 74 in retainer 56 and are threaded into bores 77 in end section 11 to mount retainer 56 on end section 11. Retainer 56 is mounted on end section 12 in a similar manner. Retainer 56 is a generally rectangular member having a width substantially the same as the width of base 53. Retainer 56 has an outwardly directed flange 73 that cooperates with lip 62 of movable member 54 to lock latch 49. Pockets 72 provided in the end of retainer 56 accommodate tabs 66 extending outwardly from base 53.

Referring to FIGS. 13 and 14, retainer 56 is attached adjacent the end of section 12 with pockets 72 facing tabs 66 of base 53. Retainer 56 and base 53 are located at equal distances from the side walls 19 and 23 of end section 12 and center section 13, respectively, so that side walls 19 and 23 are in longitudinal alignment and the adjacent ends of sections 12 and 13 are located in side-by-side relation when tabs 66 are positioned in pockets 72. Tabs 66 and pockets 72 cooperate to prevent lateral movement between end section 12 and center section 13. Tabs 66 and pockets 72 also serve to facilitate the alignment of sections 12 and 13 during assembly of bed foundation 10.

To close latch 49, tabs 66 are inserted into pockets 72 and movable member 54 is pivoted into engagement with retainer 56. Hinge 57 expands to allow middle portion 58 to swing upwardly away from the bottom surface of center section 13 whereby lip 62 of movable member 54 moves forwardly of flange 73 of retainer 56. Hinge 59 expands to allow the forward end of movable member 54 to be pivoted toward retainer 56, as indicated by arrow 78 in FIG. 13, to hook lip 62 on flange 73. Pressure is then applied to the top of movable member 54 to move member 54 into engagement with the bottom surfaces of sections 12 and 13. Base 53, middle section 58 and retainer 56 are located in recess 61 of movable member 54 when the member 54 is moved into engagement with sections 12 and 13. Hinges 57 and 59 contract, and post 63 fits tightly into hole 64. Lip 62 engages flange 73 to lock latch 49 in the closed position, as shown in FIG. 14. When latch 49 is in the closed position, adjacent portions of covers 83 of sections 12 and 13 are compressed so that there is no gapping between adjacent ends of sections 12 and 13. Movable member 54 can be released from retainer 56 to open latch 49 so that end section 12 can be removed from bed foundation 10. Other types of releasable fasteners can be used to releasably lock sections 11 to 14 together.

Returning to FIG. 3, bed foundation 10 has a pair of longitudinal support beams 31 and 32 and a transverse support beam 33. Beams 31 to 33 each have a length that is shorter than the diagonal length of end sections 11 and 12. Beams 31 to 33 can be packed within one of the end sections for shipping purposes. Transverse beam 33 extends between side walls 23 and 24 of center sections 13 and 14. Longitudinal beam 31 extends between end wall 17 of end section 11 and transverse beam 33. Longitudinal beam 32 extends from transverse beam 33 to end wall 21 of end section 12. Transverse beam 33 has a width that is slightly wider than the widths of longitudinal beams 31 and 32 whereby the bottom edge of beam 33 is located in a horizontal plane below the bottom edges of beams 31 and 32. Beams 31 to 33 provide longitudinal and lateral support for sections 11 to 14 of bed foundation 10.

A bracket 34 mounted on a middle portion of end wall 17 accommodates one end of longitudinal beam 31. The opposite end of longitudinal beam 31 is accommodated by bracket 39 secured to a middle portion of transverse beam 33. End wall 21 has a centrally located bracket 36 accommodating one end of longitudinal beam 32. The other end of longitudinal beam 32 is located in bracket 41 mounted on a middle portion of transverse beam 33. Brackets 39 and 41 are mounted on opposite side surfaces of transverse beam 33. Brackets 34, 36, 39 and 41 are in longitudinal alignment whereby longitudinal beams 31 and 32 are aligned and extend normal to end walls 17 and 21 and transverse beam 33 generally along the longitudinal mid-line of bed foundation 10.

A bracket 37 mounted on a middle portion of side wall 23 accommodates one end of transverse beam 33. The opposite end of transverse beam 33 is accommodated by bracket 38 attached to a middle portion of side wall 24. Brackets 37 and 38 are in lateral alignment whereby transverse beam 33 extends normal to side walls 23 and 24 generally along the lateral mid-line of bed foundation 10.

Figure 9:
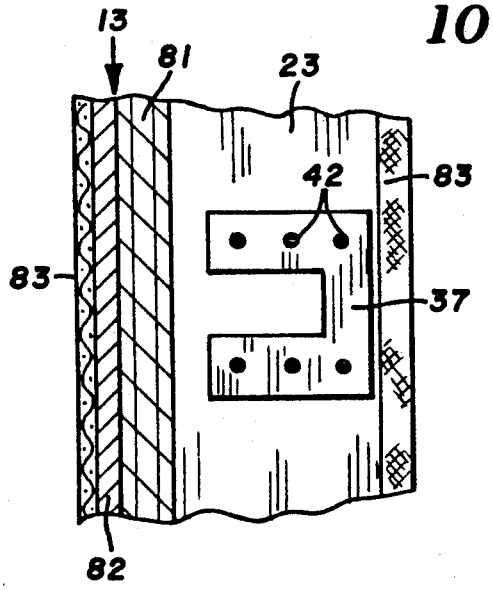
FIG. 9 is an enlarged sectional view taken along the line 9—9 of FIG. 8.

Brackets 34, 36, 37, 38, 39 and 41 are generally U-shaped holders that accommodate the ends of longitudinal beams 31 and 32 and transverse beam 33. As shown in FIGS. 5 and 9, brackets 34 and 37 are secured to the inner surfaces of walls 17 and 23, respectively, with a plurality of screws 42. Each bracket 34, 37 has a pair of laterally spaced legs that extend upwardly toward the bottom surfaces of sections 11 and 13. The bracket 34, 37 has a central slot that is open to the top of the bracket 34, 37. Brackets 36, 38, 39 and 41 are identical to brackets 34 and 37.

Figure 11:
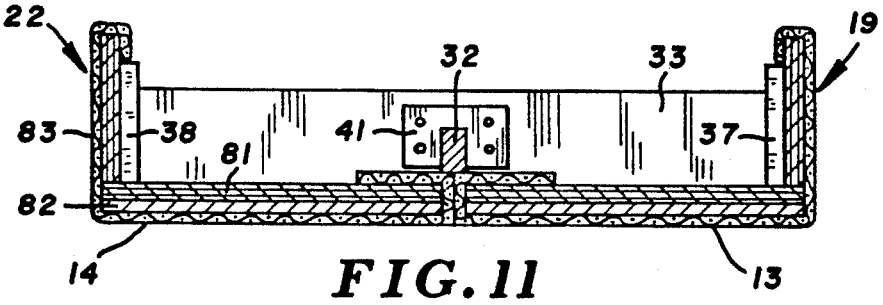
FIG. 11 is an enlarged sectional view taken along the line 11—11 of FIG. 1.
Figure 12:
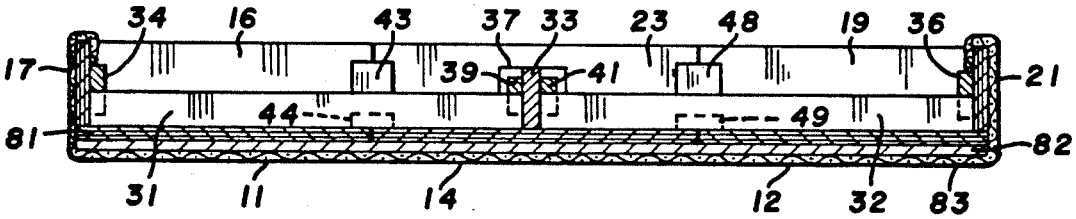
FIG. 12 is an enlarged sectional view taken along the line 12—12 of FIG. 1.

As shown in FIGS. 11 and 12, the ends of longitudinal beams 31 and 32 fit tightly into the slots of brackets 34, 36, 39 and 41. The top and bottom surfaces adjacent the ends of beams 31 and 32 engage the bottom walls of the slots of brackets 34, 36, 39 and 41 and the bottom surfaces of sections 11 to 14 to retain the ends of the beams 31 and 32 within the brackets. The ends of transverse beam 33 are accommodated by the slots of brackets 37 and 38 in a tight fit relation. Each end of transverse beam 33 has a lower groove open to the bottom and end surfaces of beam 33 to define a shoulder. The shoulders engage the bottom walls of the slots of brackets 37, 38 and the top surface of beam 33 engages the bottom surfaces of center sections 13, 14 to hold the ends of beam 33 within brackets 37 and 38. The bottom surface of beam 33 is located below the bottom portion of the slots of brackets 37 and 38.

Figure 15:
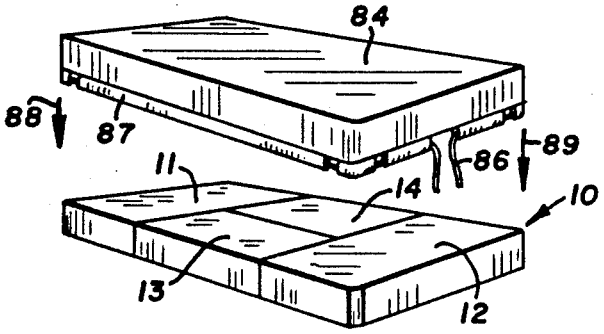
FIG. 15 is a top perspective view of the foundation and the cover therefor.

Referring to FIG. 15, a foundation cover 84 is fitted over the top of bed foundation 10. Foundation cover 84 has a looped end 87 that accommodates a draw string 86. Draw string 86 can be tightened to secure cover 84 on foundation 10. Cover 84 is pulled down over the sides of foundation 10, as indicated by arrows 88 and 89 in FIG. 15. The foundation 10 is then turned over and draw string 86 is tied together to draw the ends of cover 84 adjacent the inner side surfaces of sections 11 to 14. Cover 84 can be removed for cleaning and replacement purposes.

To assemble bed foundation 10, center sections 13 and 14 are placed top side down on a flat support surface such as a floor. One end of transverse beam 33 is inserted into the slot of bracket 37 mounted on side wall 23 of section 13. Center section 14 is moved to a position adjacent center section 13 whereby the opposite end of transverse beam 33 extends into the slot of bracket 38 mounted on side wall 24 of section 14 and the adjacent side edges of sections 13 and 14 are in side-by-side relation. The ends of transverse beam 33 are held within the slots of brackets 37 and 38 with a friction fit.

End section 11 is placed top side down on the support surface adjacent center sections 13 and 14. One end of longitudinal beam 31 is inserted in the slot of bracket 34 secured to end wall 17 of section 11. End section Il is then moved to a position adjacent the upper edges of center sections 13 and 14 so that the opposite end of longitudinal beam 31 extends into the slot of bracket 39 secured to transverse beam 33. This positions adjacent ends of end section 11 and center sections 13 and 14 in end-to-end relation. Bases 53 and retainers 56 of latches 43, 44, 46 and 47 are moved into alignment. Tabs 66 are positioned in pockets 72 to ensure proper alignment of sections 11 to 13. The ends of longitudinal beam 31 have a tight fit relation with brackets 34 and 39. Latches 43, 44, 46 and 47 are locked to connect end section 11 to center sections 13 and 14.

In a similar manner, end section 12 is connected to center sections 13 and 14 opposite end section 11. With section 12 bottom side up, an end of longitudinal beam 32 is moved into the slot of bracket 36 on wall 21. End section 12 is positioned adjacent the lower edges of center sections 13 and 14 whereby the other end of longitudinal beam 32 projects into the slot of bracket 41 on transverse beam 33. The adjacent ends of end section 12 and center sections 13 and 14 are located in end-to-end relation. Bases 53 and retainers 56 of latches 48, 49, 51 and 52 are in alignment whereby the latches can be locked to secure end section 12 and center sections 13 and 14 together. Proper alignment of sections 12 to 14 is ensured by the positioning of tabs 66 in pockets 72.

Latches 43, 44, 46 to 49, 51 and 52 secure adjacent ends of sections 11 to 14 in tight fitting relation. The cover material 83 surrounding the edges of sections 11 to 14 is compressed so that there is no gapping between sections 11 to 14. The latches can be released to allow the sections 11 to 14 to be separated.

The assembled bed foundation 10 is turned over with the top surface of the foundation facing upwardly so that cover 84 can be pulled over foundation 10. Draw string 86 is tightened and tied to secure cover 84 on foundation 10.

Figure 16:
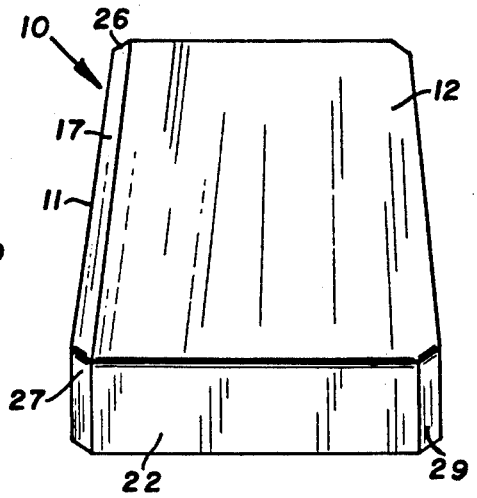
FIG. 16 is a side elevational view of the stacked foundation components.
Figure 17:
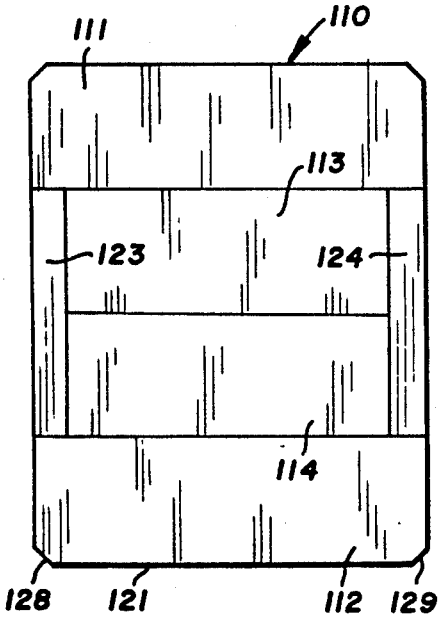
FIG. 17 is a top plan view of a modification of the foundation of the invention.
Figure 18:
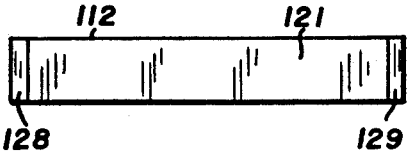
FIG. 18 is an end view thereof.
Figure 19:
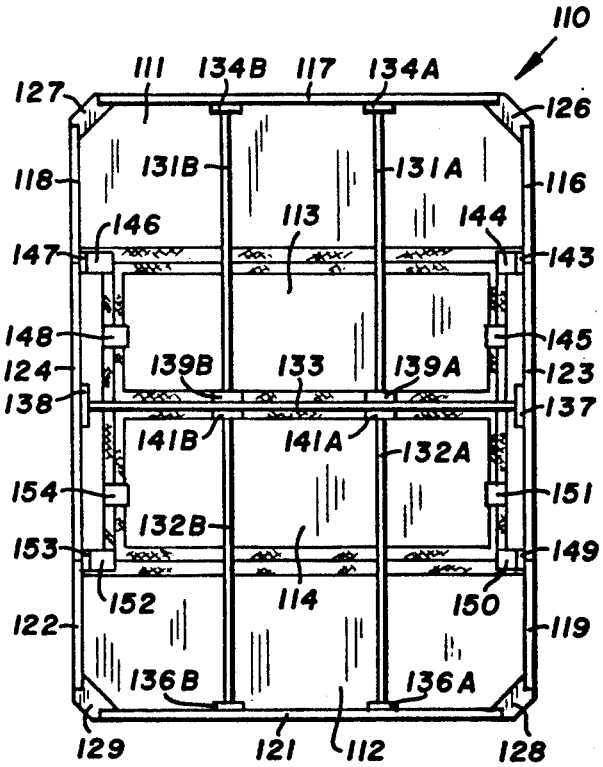
FIG. 19 is an enlarged bottom view thereof.
Figure 20:
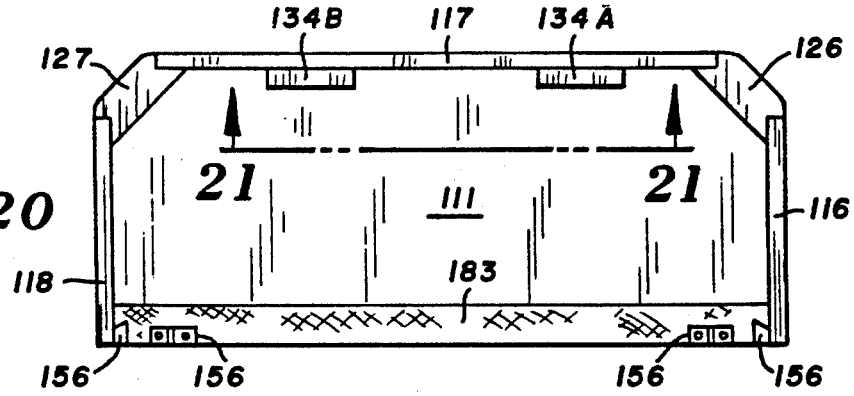
FIG. 20 is an enlarged bottom view of an end section of the foundation of FIG. 17.
Figure 23:
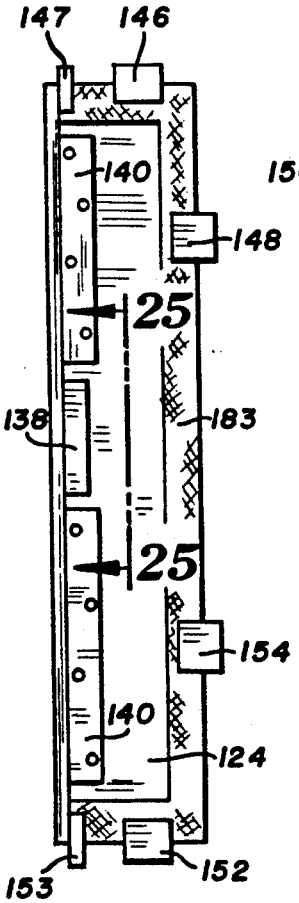
FIG. 23 is an enlarged bottom view of a side member of the foundation of FIG. 17.
Figure 24:
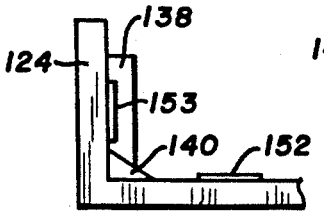
FIG. 24 is an enlarged end view of the side member.

As shown in FIG. 16, sections 11 to 14 of bed foundation 10 can be knocked down and stacked together for shipping or storage. Latches 43, 44, 46 to 49, 51 and 52 are opened so that sections 11 to 14 can be separated from each other and beams 31 to 33 can be removed from brackets 34, 36 to 39 and 41. End section 11 is inverted so that its top surface faces downwardly. Beams 31 to 33 and center sections 13 and 14 are stacked within the interior of end section 11 between walls 16, 17 and 18. The dimensions of center sections 13 and 14 are smaller than the dimensions of end section 11 allowing the center sections to be stacked therein. Beams 31 to 33 are placed diagonally across the interior of section 11. End section 12 is placed over end section 11 with end wall 21 located opposite from end wall 17 of section 11. Side wall 19 of section 12 is located adjacent the outer surface of side wall 18 of section 11. Side wall 2 of section 12 is positioned adjacent the inner surface of side wall 16 of section 11. When the sections and beams of bed foundation 10 are stacked in this manner, the knocked down foundation 10 can fit into a box having a size substantially the same as the size of one of the end sections 11, 12. The box size is within the shipping limits of UPS, i.e., 130 inches transverse peripheral and length. This facilitates shipping and reduces transportation costs. Bed foundation 10 can be manufactured at a single location and shipped directly to the retailer or user. Referring to FIGS. 17 to 25, there is shown a modification of the bed foundation of the invention indicated generally at 110 having a plurality of sections that are interlocked together to form a stationary structure for supporting a double bed sized mattress, such as an air mattress. Bed foundation 110 has generally rectangular end sections 111 and 112 joined to generally rectangular center sections 113 and 114 and side sections 123 and 124. The sections 111 to 114, 123 and 124 are of a size so that they can be stacked together for storage and shipping. The sections of foundation 110 can fit into a box having a size within the shipping limits of UPS. Sections 111 to 4, 123 and 124 can be moved separately by one person into a room for assembly. Tools, such as wrenches and screw drivers, are not required to assemble bed foundation 110. Referring to FIG. 19, end section 111 of foundation 110 has side walls 116 and 118 Connected to an end wall 117 with corner supports 126 and 127. End section 112 has side walls 119 and 122 connected to an end wall 121 with corner supports 128 and 129. The outer side edges of center sections 113 and 114 are secured to side sections 123 and 124. Center sections 113 and 114 and side sections 123 and 124 are shorter than end sections 111 and 112. This enables the center and side sections to be packed within one of the end sections for shipping. Each of the side sections 123 and 124 has a downwardly directed side wall. As shown in FIG. 23, triangular braces 140 secured to side section 124 support the side wall of section 124. Similar triangular braces attached to side section 123 support the side wall of section 123. Returning to FIG. 19, side walls 116 and 119 of end sections 111 and 112 are in longitudinal alignment with the side wall of side section 123. Side walls 118 and 122 of end sections 111 and 112 are longitudinally aligned with the side wall of side section 124. The side and end walls of sections 111, 112, 123 and 124 are wood beams that are connected to the peripheral edges of foundation 110.

Figure 25:
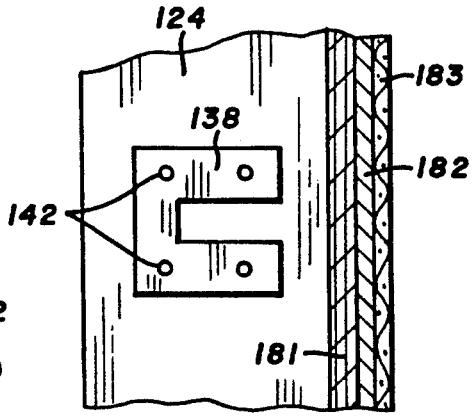
FIG. 25 is an enlarged sectional view taken along the line 25—25 of FIG. 23.
Figure 26:
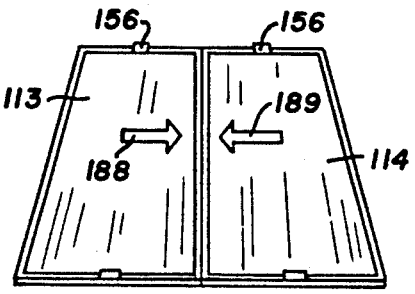
FIG. 26 is a bottom elevational view showing the assembly of the center sections of the foundation shown in FIG. 17.
Figure 27:
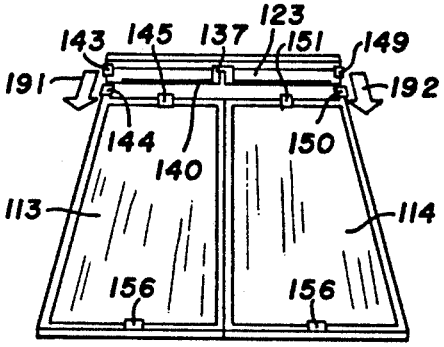
FIG. 27 is a bottom elevational view showing the assembly of a side member to the center sections.

Each of the end, center and side sections 111 to 114, 123 and 124 has a top panel 181 made of plywood, hardboard, chipboard and like sheet members. As shown in FIG. 25, a middle layer 182 of cardboard is secured to the top of the panel 181. A cover 183 made of cloth or like textile material extends over the top of cardboard layer 182 and the outer peripheral edges of each section 111 to 114, 123 and 124. The ends of cover 183 are secured to the bottom and inner surfaces of each section.

A plurality of releasable latches 143, 144, 145, 146, 147, 148, 149, 150, 151, 152, 153 and 154 are used to hold end sections 111 and 112, center sections 113 and 114 and side sections 123 and 124 together. Latches 143 to 154 prevent relative movement between sections 111 to 114, 123 and 124.

As shown in FIG. 19, latches 143, 144, 146 and 147 connect adjacent ends of end section 111 and side sections 123 and 124. Latches 143 and 147 are mounted on adjacent ends of side walls 116 and 118 and the side walls of sections 123 and 124. Latches 144 and 146 are mounted on adjacent bottom surfaces of panels 181 of end section 111 and side sections 123 and 124. Adjacent ends of end section 112 and side Sections 123 and 124 are connected with latches 149, 150, 152 and 153 in an identical manner. Latches 149 and 153 are secured to adjacent ends of side walls 119 and 122 and the side walls of sections 123 and 124. Latches 150 and 152 are secured to adjacent bottom surfaces of panels 181 of end section 112 and side sections 123 and 124. Adjacent sides of center sections 113 and 114 and side sections 123 and 124 are connected with latches 145, 148, 151 and 154 that are mounted on adjacent bottom surfaces of panels 181 of sections 113, 114, 123 and 124. Latches 143 to 154 can be easily locked and released to facilitate assembly and knock down of bed foundation 110.

Latches 143 to 154 are generally flat releasable locking devices which are identical in structure and function to latch 49, as shown in FIGS. 13 and 14 and described above. Each of the latches 143 to 154 hooks onto a retainer 156 to lock the latch. When the latch is in the closed position, adjacent portions of covers 183 of sections 111 to 114, 123 and 124 are compressed so that there is no gapping between adjacent ends and sides of the sections. Latches 143 to 154 can be released so that sections 111 to 114, 123 and 124 can be separated from bed foundation 110. Other types of releasable fasteners can be used to releasably lock sections 111 to 114, 123 and 124 together.

Returning to FIG. 19, bed foundation 110 has plurality of longitudinal support beams 131A, 131B, 132A and 132B and a transverse support beam 133. Beams 131A to 132B and 133 each have a length that is shorter than the diagonal length of end sections 111 and 112. This allows beams 131A to 132B and 133 to be packed within one of the end sections for shipping purposes. Transverse beam 133 extends between the side walls of side sections 123 and 124. Longitudinal beams 131A and 131B are laterally spaced and extend between end wall 117 of end section 111 and transverse beam 133. Laterally spaced longitudinal beams 132A and 132B extend from transverse beam 133 to end wall 121 of end section 112. Transverse beam 133 has a width that is slightly wider than the widths of longitudinal beams 131A, 131B, 132A and 132B whereby the bottom edge of beam 133 is located in a horizontal plane below the bottom edges of beams 131A to 132B. Beams 131A to 133 provide longitudinal and lateral support for sections 111 to 114, 123 and 124 of bed foundation 110.

Laterally spaced brackets 134A and 134B mounted on end wall 117 accommodate one end of each longitudinal beam 131A and 131B. The opposite ends of beams 131A and 131B are accommodated by laterally spaced brackets 139A and 139B mounted on transverse beam 133. End wall 121 has laterally spaced brackets 136A and 136B that accommodate one end of each longitudinal beam 132A and 132B. The other ends of beams 132A and 132B are located in laterally spaced brackets 141A and 141B mounted on transverse beam 133. Brackets 139A, 139B and 141A, 141B are mounted on opposite side surfaces of beam 133. Brackets 134A, 139A, 141A and 136A are in longitudinal alignment so that longitudinal beams 131A and 132A are aligned and extend normal to end walls 117 and 121 and transverse beam 133. Brackets 134B, 139B, 141B and 136B are longitudinal]y aligned thereby aligning beams 131B and 132B and holding beams 131B and 132B normal to end walls 117 and 121 and transverse beam 133.

A bracket 137 mounted on a middle portion of the side wall of side section 123 accommodates one end of transverse beam 133. The opposite end of beam 133 is located in bracket 138 attached to a middle portion of the side wall of side section 124. Brackets 137 and 138 are in lateral alignment whereby transverse beam 133 extends normal to the side walls of sections 123 and 124 generally along the lateral center line of bed foundation 110.

Figure 21:
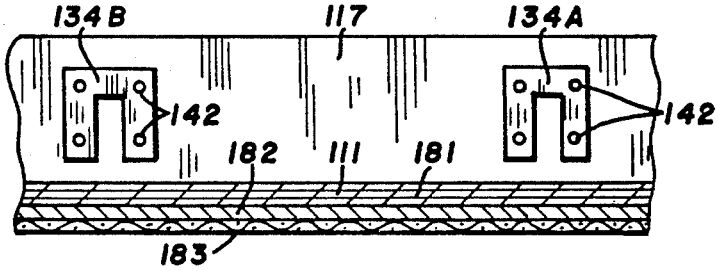
FIG. 21 is an enlarged sectional view taken along the line 21—21 of FIG. 20.
Figure 22:
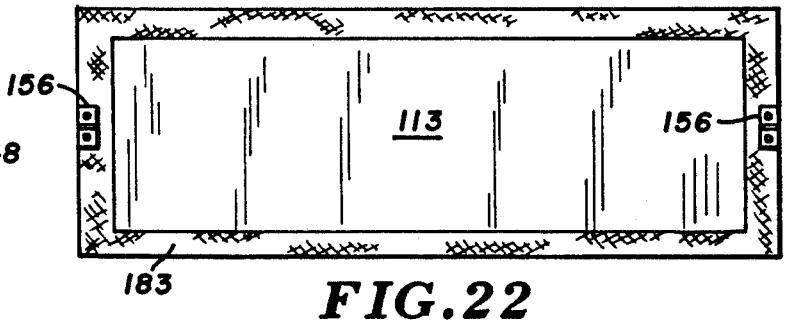
FIG. 22 an enlarged bottom view of a center section of the foundation of FIG. 17.

Brackets 134A, 134B, 136A, 136B, 137, 138, 139A, 139B, 141A and 141B are generally U-shaped holders that accommodate the ends of beams 131A, 131B, 132A, 132B and 133. As shown in FIGS. 21 and 25, brackets 134A, 134B and 138 are connected to the inner surfaces of end wall 117 and the side wall of side section 124 with a plurality of screws 142. Each bracket 134A, 134B, 138 has a pair of laterally spaced legs that extend upwardly toward the bottom surface of bed foundation 110. The bracket has a central slot that is open to the top of the bracket. Brackets 136A, 136B, 137, 139A, 139B, 141A and 141B are identical to brackets 134A, 134B and 138.

Figure 28:
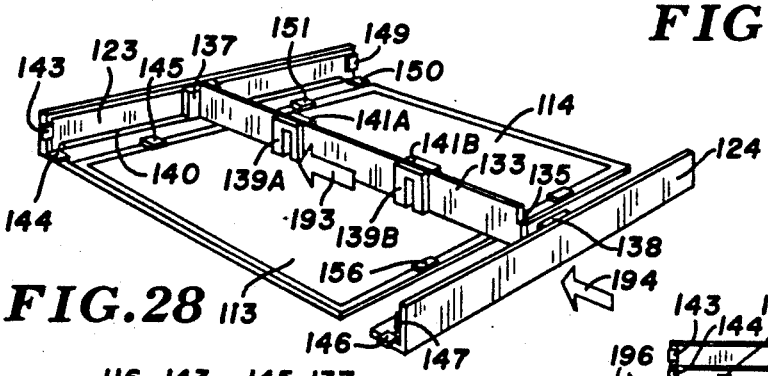
FIG. 28 is a bottom perspective view showing the assembly of a transverse support and a second side member to the first side member and the center sections.
Figure 30:
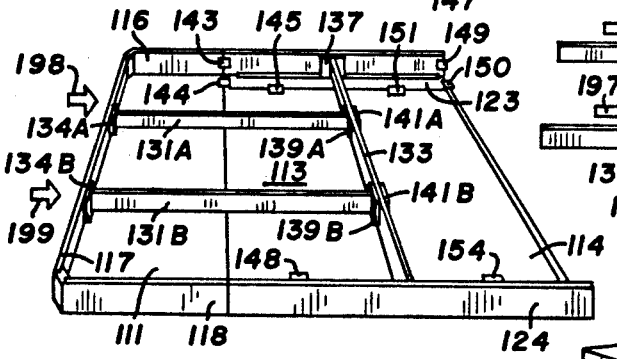
FIG. 30 is a bottom elevational view showing the assembly of an end section to the center section, side members and longitudinal supports.

The ends of longitudinal beams 131A to 132B fit tightly into the slots of brackets 134A, 134B, 136A, 136B, 139A, 139B, 141A and 141B. The top and bottom surfaces adjacent the ends of beams 131A to 132B engage the bottom surfaces of sections 111 to 114 and the bottom walls of the slots of the brackets to retain the ends of beams 131A to 132B within brackets 134A, 134B, 136A, 136B, 139A, 139B, 141A and 141B. The ends of transverse beam 133 are accommodated by the slots of brackets 137 and 138 in a tight fit relation. As shown in FIG. 28, each end of transverse beam 133 has a lower groove that is open to the bottom and end surfaces of beam 133 to define a shoulder 135. Shoulders 135 engage the bottom walls of the slots of brackets 137 and 138 and the top surface of beam 133 engages the bottom surfaces of side sections 123 and 124 to hold the ends of beam 133 within brackets 137 and 138. The bottom surface of beam 133 is located below the bottom portion of the slots of brackets 137 and 138.

Figure 32:
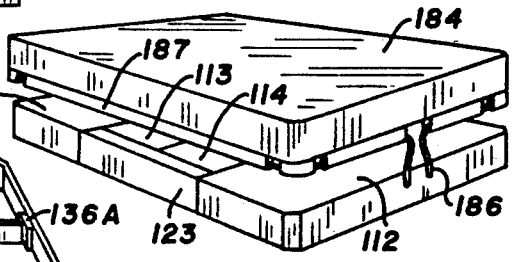
FIG. 32 is a top perspective view of the foundation of FIG. 17 and the cover therefor.

Referring to FIG. 32, a foundation cover 184 is fitted over the top of bed foundation 110. Cover 184 has a looped end 187 accommodating a draw string 186 that can be tightened to secure cover 184 on foundation 110. Cover 184 can be removed from foundation 110 for cleaning and replacement, if necessary.

As shown in FIGS. 26 to 32, bed foundation 110 is assembled by placing center sections 113 and 114 top side down on a flat support surface, such as a floor. Sections 113 and 114 are moved toward each other, as indicated by arrows 188 and 189 in FIG. 25, to align the sections 113 and 114 in end-to-end relation. Side section 123 is placed top side down on the support surface adjacent one side of center sections 113 and 114. Side section 123 is then moved to a position adjacent the side edges of sections 113 and 114, as indicated by arrows 191 and 192 in FIG. 27, so that sections 113, 114 and 123 are aligned in side-by-side relation. Latches 145 and 151 are locked to connect side section 123 to center sections 113 and 114.

One end of transverse beam 133 is inserted into the slot of bracket 137 mounted on side section 123, as indicated by arrow 193 in FIG. 28. Side section 124 is placed top side down on the support surface adjacent the opposite side of center sections 113 and 114. Side section 124 is then moved to a position adjacent the opposite side edges of sections 113 and 114, as indicated by arrow 194 in FIG. 28, whereby sections 113, 114 and 124 are aligned in side-by-side relation and the opposite end of transverse beam 133 extends into the slot of bracket 138 mounted on side section 124. Shoulders 135 engage the bottom walls of the slots of brackets 137, 138 and the top surface of beam 133 engages the bottom surfaces of sections 123 and 124 so that the ends of beam 133 have a tight fit relation with brackets 137 and 138. Latches 148 and 154 are locked to connect side section 124 to center sections 113 and 114.

Figure 29:
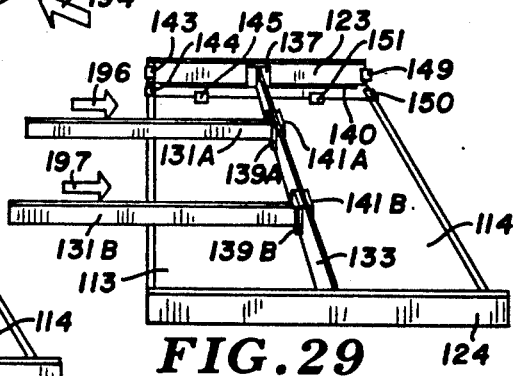
FIG. 29 is a bottom elevational view showing the assembly of a pair of longitudinal supports to the transverse support.
Figure 31:
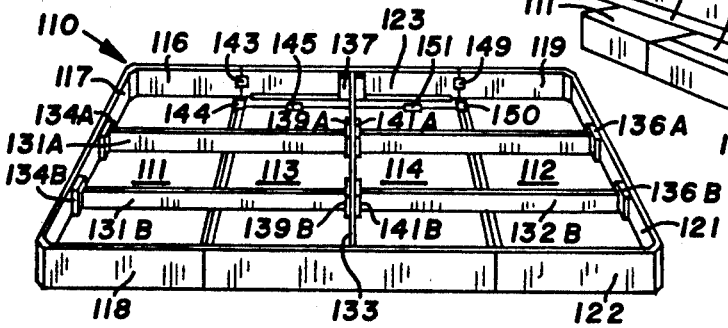
FIG. 31 is a bottom elevational view showing the fully assembled foundation of FIG. 17.

Ends of longitudinal beams 131A and 131B are inserted into the slots of brackets 139A and 139B mounted on transverse beam 133, respectively, as indicated by arrows 196 and 197 in FIG. 29. End section 111 is positioned top side down on the support surface adjacent one end of center section 113 and side sections 123 and 124. End section 111 is then moved to a position adjacent the end edges of sections 113, 123 and 124, as indicated by arrows 198 and 199 in FIG. 30, whereby end section 111 is aligned in end-to-end relation with sections 113, 123 and 124. The opposite ends of longitudinal beams 131A and 131B extend into the slots of brackets 134A and 134B mounted On end Wall 117. The top and bottom surfaces adjacent the ends of beams 131A and 131B engage the bottom surfaces of end section 111 and center section 113 and the bottom walls of the slots of brackets 134A, 134B, 139A and 139B whereby the ends of beams 131A and 131B have a tight fit relation with the brackets. Latches 143, 144, 146 and 147 are locked to secure end section 111 to center section 113 and side sections 123 and 124.

In a similar manner, end section 112 is connected to center section 114 and side sections 123 and 124 opposite end section 111. Ends of longitudinal beams 132A and 132B are inserted into the slots of brackets 141A and 141B. With end section 112 bottom side up, section 112 is moved adjacent the end edges of sections 114 123 and 124. End section 112 is aligned in end-to-end relation with sections 114, 123 and 124 and the opposite ends of beams 132A and 132B extend into the slots of brackets 136A and 136B. The ends of beams 132A and 132B have a tight fit relation with brackets 136A, 136B, 141A and 141B. Latches 149, 150, 152 and 153 are fastened to attach end section 112 to center section 114 and side sections 123 and 124.

Latches 143 to 154 secure adjacent ends and sides of sections 111 to 114, 123 and 124 in tight fitting relation whereby cover material 183 surrounding the edges of the sections is compressed. This prevents gapping between sections 11 to 114, 123 and 124.

The assembled bed foundation 110 is turned over so that the top surface of the foundation faces up. Cover 184 can then be fitted over foundation 110, as shown in FIG. 32. Draw string 186 is tightened and tied to secure cover 184 on foundation 110.

Sections 111 to 114, 123 and 124 of foundation 110 can be knocked down and stacked for shipping or storage. Latches 143 to 154 are unlocked to allow the sections to be separated from each other. Beams 131A to 132B and 133 are separated from brackets 134A, 134B, 136A, 136B, 137, 138, 139A, 139B, 141A and 141B. The knocked down bed foundation 110 can be stacked so that it fits into a box having a size within the shipping limits of UPS, i.e., 130 inches transverse peripheral and length, whereby shipping is facilitated and transportation costs are reduced. Center sections 113 and 114 and side sections 123 and 124 are placed within one of the end sections 111, 112. Beams 131A to 132B and 133 are placed diagonally across the end section. The other end section is positioned on top of the first end section whereby the size of the box needed to ship the knocked down foundation is substantially the same as the size of the end section 111, 112.

While there has been show and described preferred embodiments of the bed foundation of the invention, it is understood that changes in materials, structure, and arrangement of structure may be made by those skilled in the art without departing from the invention. The invention is defined in the following claims.

I claim:

1. A foundation for a bed comprising: a first end member, a second end member, and a pair of center members, each of said members having a generally horizontal support surface providing a support for a mattress, means releasably connecting the end members to the center members to hold the support surfaces aligned with each other, said means being releasable to allow the members to be separated from each other, the means releasably connecting the end members to the center members comprises a plurality of releasable latches mounted on adjacent surfaces of the end members and center members, each latch having a base secured to one adjacent surface, the base having at least one outwardly directed tab, a retainer secured to opposite adjacent surface, the retainer having a groove adapted to accommodate the tab thereby ensuring proper alignment of the end members relative to the center members, and a latching member pivoted on the base and engageable with the retainer to lock the base and the retainer together, longitudinal and transverse support means mounted on the members to support the end members and center members and maintain the alignment of the support surfaces, and bracket means releasably accommodating the support means to mount the support means on the members, said support means being releasable from the bracket means to allow the end members, center members and support means to be separated from each other.

2. The foundation of claim 1 wherein: the center members each have a size smaller than the size of each end member.

3. The foundation of claim 1 including: hinge means connecting the base to the latching member, the hinge means movable between an expanded position and a contracted position to allow the latching member to engage the retainer and lock the base and retainer together.

4. The foundation of claim 1 wherein: the support means comprises transverse support means extending between the center members, a first longitudinal support extended between the first end member and the transverse support means, and a second longitudinal support extended between the second end member and the transverse support means in axial alignment with the first longitudinal support.

5. A foundation for a bed comprising: a first end member, a second end member, and a pair of center members, each of said members having a generally horizontal support surface providing a support for a mattress, means releasably connecting the end members to the center members to hold the support surfaces aligned with each other, said means being releasable to allow the members to be separated from each other, longitudinal and transverse support means mounted on the members to support the end members and center members and maintain the alignment of the support surfaces, said support means comprising transverse support means extended between the center members, a first longitudinal support extended between the first end member and the transverse support means, a second longitudinal support extended between the second end member and a transverse support means in axial alignment with the first longitudinal support, and bracket means releasably accommodating the support means to mount the support means on the members, the bracket means comprises a plurality of U-shaped brackets having upright sides and a base secured to the end members, center members and transverse support, each support having opposite ends, each end being located between the opposite sides of one of the brackets with a friction fit and engageable with the base, said support means being releasable from the bracket means to allow the end members, center members and support means to be separated from each other.

6. The foundation of claim 5 wherein: the bracket means includes a first U-shaped bracket secured to one side of the transverse support, and a second U-shaped bracket attached to the opposite side of the transverse support adjacent the first bracket, the first and second brackets holding adjacent ends of the first and second longitudinal supports in longitudinal alignment with each other.

7. The foundation of claim 5 wherein: each end member has a diagonal length, each support has a length shorter than the diagonal length of each end member.

8. A foundation for a bed comprising: a first end means and a second end means, center means joined to the first and second end means, each of said end means and center means having a generally horizontal support surface providing a support for a mattress, transverse support means mounted on the center means, first longitudinal support means extending between the first end means and the transverse support means, second longitudinal support means extending between the second end means and the transverse support means in longitudinal alignment with the first longitudinal support means, first bracket means mounted on the end means to releasably support one end of each longitudinal support means on the end means, second bracket means mounted on the center means to releasably support the transverse support means on the center means, third bracket means mounted on the transverse support means to releasably support the other end of each longitudinal support means on the transverse support means to hold the support surfaces aligned with each other, said first, second, and third bracket means each comprises a plurality of U-shaped brackets having upright sides and base secured to said end means, center means, and transverse support means, each support means having opposite ends, each end being located between the opposite sides of one of the brackets with a friction fit and engageable with the base, and means releasably connecting the first and second end means to the center means to hold the first and second end means, center means, longitudinal support means and transverse support means in assembled relation with each other and allow the end means to be separated from the center means, whereby the end means, center means, and support means can be separated from each other.

9. The foundation of claim 8 wherein the center means has a size smaller than the size of each end means.

10. The foundation of claim 8 wherein: the means releasably connecting the first and second end means to the center means comprises a plurality of releasable latches mounted on adjacent surfaces of the end means and center means, each latch having a latch base secured to one adjacent surface, a retainer secured to an opposite adjacent surface, and a latching member pivoted to the latch base and engageable with the retainer to lock the latch base and retainer together.

11. The foundation of claim 10 wherein: the latch base has at least one outwardly directed tab, the retainer having a groove adapted to accommodate the tab thereby ensuring proper alignment of the end means relative to the center means.

12. The foundation of claim 10 including: hinge means connecting the latch base to the latching member, the hinge means movable between an expanded position and a contracted position to allow the latching member to engage the retainer and lock the latch base and retainer together.

13. The foundation of claim 10 wherein: the end means and center means each have a cover surrounding each adjacent surface, the latch compressing the cover when connecting the adjacent surfaces together to prevent gapping between the surfaces.

14. The foundation of claim 8 wherein: each end member has a diagonal length, each support means has a length shorter than the diagonal length of each end means.

15. The foundation of claim 8 wherein: the center means comprises a first side member, a second side member, and a pair of center members, first latch means releasably connecting the center members to the first and second side members, and second latch means releasably connecting the first end means and the second end means to the side members to form the support.

16. The foundation of claim 15 wherein: the means releasably connecting the first and second end means to the center means comprises a plurality of releasable latches mounted on adjacent surfaces of the end means and the side members.

17. The foundation of claim 15 wherein: the transverse support means comprises a transverse beam extending between the side members, the first longitudinal support means comprising at least one first longitudinal beam extended between the first end means and the transverse beam, the second longitudinal support means comprising at least one second longitudinal beam extended between the second end means and the transverse beam in longitudinal alignment with the first longitudinal beam.

18. The foundation of claim 8 including: cover means fitted over and removably mounted on the support.

19. A foundation for supporting a mattress comprising: first end section, a second end section, and center means joined to the first and second end sections to form a rectangular support for a mattress, the center means comprising a first side member, a second side member, and a pair of center members, first latch means releasably connecting the center members to the first and second end sections, second latch means releasably connecting the first and second end sections to the first and second side members, each latch means having a base secured to one of the members, the base having at least one outwardly directed tab, a retainer secured to an opposite adjacent member the retainer having a groove adapted to accommodate the tab thereby ensuring proper alignment of the end sections and center means, a latching member pivoted to the base and engageable with the retainer to lock the base and retainer together, support means mounted on the end sections and the side members for longitudinal and lateral support of the end and center sections and side members, means secured to the end sections and side members for releasably supporting the support means on the end sections and side members, the center sections and side members each having a size smaller than the size of each end section.

20. The foundation of claim 19 wherein: each end section, side member and center section has a cover surrounding each adjacent edge, the latch means compressing the cover when locking the adjacent edges together to prevent gapping between the edges.

21. The foundation of claim 19 wherein: the support means comprises a transverse support extending between the side members, at least one first longitudinal support extended between the first end section and the transverse support, and at least one second longitudinal support extended between the second end section and the transverse support in longitudinal alignment with the first longitudinal support.

* * * * *